US012312876B2

(12) United States Patent
Zakharia

(10) Patent No.: US 12,312,876 B2
(45) **Date of Patent: *May 27, 2025**

(54) SYSTEMS AND METHODS FOR PROVIDING BUOYANCY TO A TUBULAR STRING POSITIONED IN A WELLBORE

(71) Applicant: G&H Diversified Manufacturing LP, Houston, TX (US)

(72) Inventor: Steven Zakharia, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 3 days.

This patent is subject to a terminal disclaimer.

(21) Appl. No.: 18/534,107

(22) Filed: Dec. 8, 2023

(65) Prior Publication Data

US 2024/0102346 A1 Mar. 28, 2024

Related U.S. Application Data

(63) Continuation of application No. 17/687,369, filed on Mar. 4, 2022, now Pat. No. 11,879,299.

(60) Provisional application No. 63/156,564, filed on Mar. 4, 2021.

(51) Int. Cl.
*E21B 17/06* (2006.01)
*E21B 34/06* (2006.01)

(52) U.S. Cl.
CPC ..... *E21B 17/06* (2013.01); *E21B 34/063* (2013.01); *E21B 2200/08* (2020.05)

(58) Field of Classification Search
CPC ..... E21B 17/06; E21B 34/063; E21B 2200/08
See application file for complete search history.

(56) References Cited

U.S. PATENT DOCUMENTS

2010/0019456 A1* 1/2010 Gerrard ..... C01B 32/158 277/336
2020/0032611 A1* 1/2020 Martin ..... F16L 55/11
2021/0017833 A1* 1/2021 Saraya ..... E21B 33/1208

* cited by examiner

*Primary Examiner* — Yanick A Akaragwe
(74) *Attorney, Agent, or Firm* — Conley Rose, P.C.

(57) ABSTRACT

A dissolvable barrier assembly includes a holder configured to couple to a casing string and defining a central aperture, a barrier configured to prevent the communication of fluid across the barrier, wherein the barrier comprises an outer surface including an uphole surface defining an uphole end and a downhole surface defining a downhole end opposite the uphole end and having a greater surface area than the uphole surface, wherein at least a portion of the uphole surface is configured to corrode when in contact with the uphole fluid at a first corrosion rate and also wherein at least a portion of the downhole surface is configured to corrode when in contact with the uphole fluid at a second corrosion rate that is greater than the first corrosion rate.

21 Claims, 5 Drawing Sheets

SYSTEMS AND METHODS FOR PROVIDING BUOYANCY TO A TUBULAR STRING POSITIONED IN A WELLBORE

CROSS-REFERENCE TO RELATED APPLICATIONS

The present application is a continuation of U.S. non-provisional patent application Ser. No. 17/687,369 filed Mar. 4, 2022, entitled "Systems and Methods for Providing Buoyancy to a Tubular String Positioned in a Wellbore", which claims benefit of U.S. provisional patent application No. 63/156,564 filed Mar. 4, 2021, entitled "Systems and Methods for Providing Buoyancy to a Tubular String," all of which are incorporated herein by reference in their entirety for all purposes.

STATEMENT REGARDING FEDERALLY SPONSORED RESEARCH OR DEVELOPMENT

Not applicable.

BACKGROUND

In drilling a wellbore into a subsurface earthen formation, such as for the recovery of hydrocarbons or minerals from the earthen formation, it is typical practice to install a casing string or liner pipe to hold the wellbore open. In many wellbores, the wellbore comprises a vertical section extending vertically downwards from the surface and undertakes a deviated or horizontal section from a heel out to a toe at a terminal end of the wellbore.

To reduce the effective weight (the weight of the casing string observed at the surface) and frictional drag created by a casing string running along a bottom of a horizontal section of the wellbore, it is known to reduce the density of the casing string relative to fluids present in the wellbore by trapping air inside of the casing string thereby making the casing string somewhat buoyant. By reducing the frictional drag between the tubular string and the wellbore wall, the total length of the horizontal section of the cased wellbore may be maximized without needing to operate more powerful and costly surface equipment for deploying the casing string, thereby increasing the production of hydrocarbons from the single wellbore. However, current systems for creating buoyant casing strings tend to be fragile and leave debris in the wellbore that requires additional systems to clear away or remove. As such, a simple, reliable and robust system for running casing deep into a horizontal leg of a wellbore would be appreciated in the hydrocarbon production industry.

SUMMARY OF THE DISCLOSURE

An embodiment of a dissolvable barrier assembly deployable with a casing string in a wellbore comprises a holder configured to couple to the casing string in a generally transverse orientation and defining a central aperture, and a barrier positioned in the central aperture of the holder and configured to prevent the communication of fluid across the barrier whereby an uphole chamber within the casing string extending uphole from the barrier and containing an uphole fluid is hydraulically isolated from a downhole chamber within the casing string extending downhole from the barrier, wherein the barrier comprises an outer surface including an uphole surface defining an uphole end and a downhole surface defining a downhole end opposite the uphole end, wherein at least a portion of the uphole surface is configured to corrode when in contact with the uphole fluid at a first corrosion rate and also wherein at least a portion of the downhole surface is configured to corrode when in contact with the uphole fluid at a second corrosion rate that is greater than the first corrosion rate, a first seal assembly positioned on a circumferentially outer surface of the holder and configured to seal an interface between the circumferentially outer surface and an inner surface of the casing string when the dissolvable barrier assembly is positioned in the casing string, and a second seal assembly positioned circumferentially between an inner surface of the holder and an outer surface of the barrier, wherein the second seal assembly is configured to seal the interface between the inner surface of the holder and the outer surface of the barrier. In some embodiments, at least one of the first seal assembly and the second seal assembly comprises an annular D-ring seal. In some embodiments, at least one of the first seal assembly and the second seal assembly comprises an annular T-ring seal. In certain embodiments, both the first seal assembly and the second seal assembly comprises an annular T-ring seal. In certain embodiments, both the first seal assembly and the second seal assembly include a D-ring seal. In some embodiments, one of the first seal assembly and the second seal assembly comprises an annular D ring seal and the other of the first seal assembly and the second seal assembly comprises an annular T seal. In some embodiments, the downhole surface of the barrier has a greater surface area than the uphole surface of the barrier. In certain embodiments, an annular shoulder is formed on the downhole surface of the barrier. In some embodiments, both the first seal assembly and the second seal assembly are each located axially between the uphole end and the downhole end of the barrier. In some embodiments, the portion of the uphole surface of the barrier configured to corrode at the first corrosion rate when in contact with the uphole fluid is defined by an uphole protective coating formed on the barrier.

An embodiment of a dissolvable barrier assembly deployable with a casing string in a wellbore comprises a holder configured to couple to the casing string in a generally transverse orientation and defining a central aperture, and a barrier positioned in the central aperture of the holder and configured to prevent the communication of fluid across the barrier whereby an uphole chamber within the casing string extending uphole from the barrier and containing an uphole fluid is hydraulically isolated from a downhole chamber within the casing string extending downhole from the barrier, wherein the barrier comprises an outer surface including an uphole surface defining an uphole end and a downhole surface defining a downhole end opposite the uphole end and having a greater surface area than the uphole surface, wherein at least a portion of the uphole surface is configured to corrode when in contact with the uphole fluid at a first corrosion rate and also wherein at least a portion of the downhole surface is configured to corrode when in contact with the uphole fluid at a second corrosion rate that is greater than the first corrosion rate. In certain embodiments, an annular shoulder is formed on the downhole surface of the barrier. In certain embodiments, the barrier comprises at least one of a magnesium-based alloy and an aluminum-based alloy. In some embodiments, the portion of the uphole surface of the barrier configured to corrode at the first corrosion rate when in contact with the uphole fluid is defined by an uphole protective coating formed on the barrier. In some embodiments, the uphole protective coating comprises at least one of a powder coating, a ceramic coating, and paint. In certain embodiments, the dissolvable barrier assembly includes a first seal assembly positioned on a circumferentially outer surface of the holder and configured to seal an interface between the circumferentially outer surface and an inner surface of the casing string when the dissolvable barrier assembly is positioned in the casing string, and a second seal assembly positioned circumferentially between an inner surface of the holder and an outer surface of the barrier, wherein the second seal assembly is configured to seal the interface between the inner surface of the holder and the outer surface of the barrier. In certain embodiments, at least one of the first seal assembly and the second seal assembly comprises an annular D-ring seal. In certain embodiments, at least one of the first seal assembly and the second seal assembly comprises an annular T-ring seal.

BRIEF DESCRIPTION OF THE DRAWINGS

A more complete understanding of the present disclosure may be obtained from the following detailed description with reference to the attached drawing figures as summarized below, in which.

DETAILED DESCRIPTION

Figure 1:
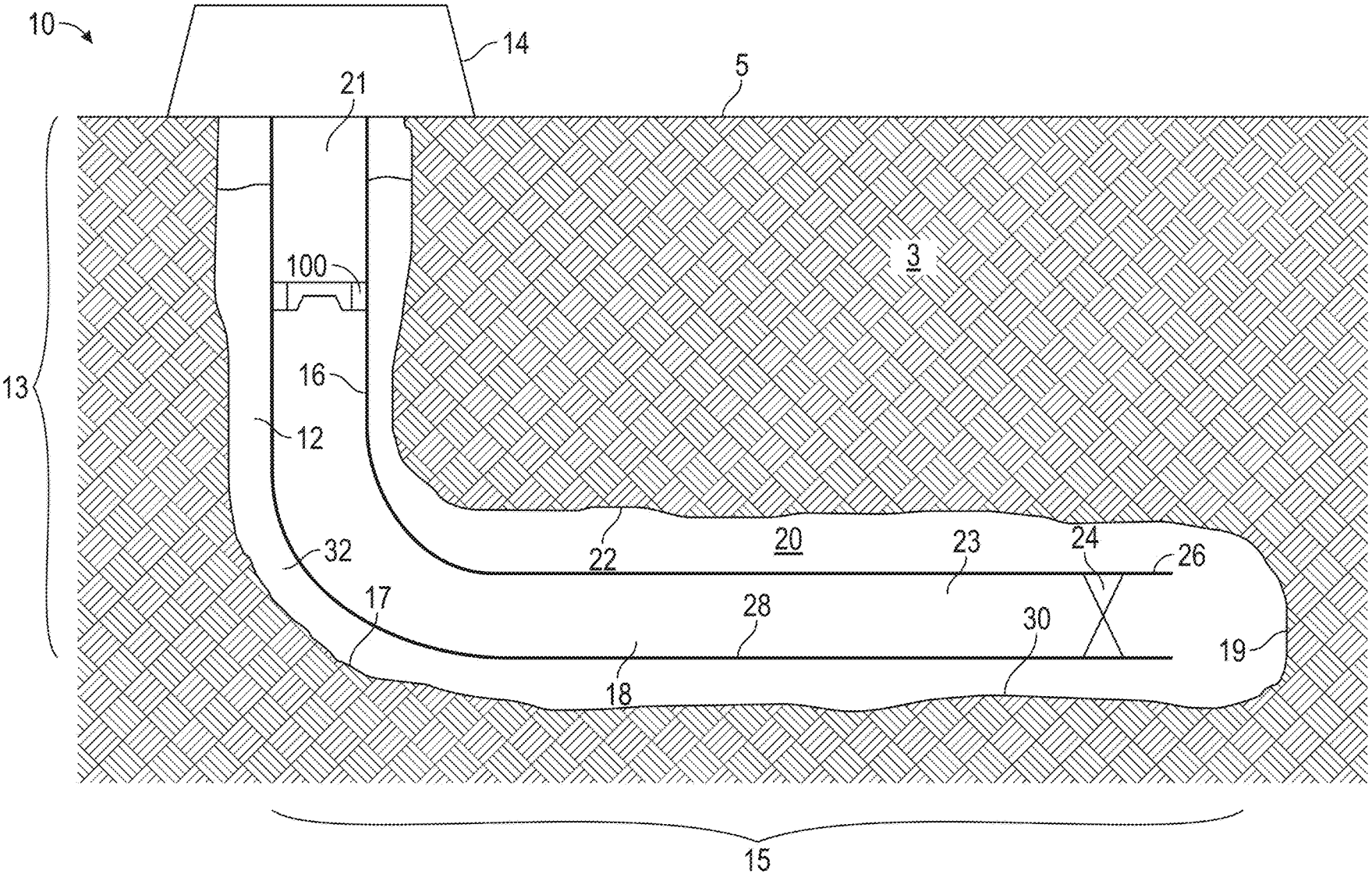
FIG. 1 is a schematic elevation view of a well system including an embodiment of a dissolvable barrier assembly inside the casing in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

Referring to FIG. 1, a well system 10 is shown including a wellbore 12 extending into a subterranean, earthen formation or ground 3 from the surface 5. A surface system 14 comprising derrick or platform is disposed at the surface 5 and a casing string 16 extends down into the wellbore 12. In this exemplary embodiment, the wellbore 12 includes a vertical section 13 extending vertically downwards from the surface 5 and a deviated or horizontal section 15 extending laterally from the vertical section. Particularly, horizontal section 15 comprises a heel section 17 at a first end thereof which adjoins and transitions to a lower or downhole end of the vertical section 13 and a toe section 19 at the terminal end of the wellbore 12.

Surface system 14 of the well system 10 may include components (e.g., a winch drum, crown and travelling blocks, a top drive assembly, etc.) for running the casing string 16 into the wellbore 12 as well as equipment (e.g., pumps, etc.) for circulating downwards fluid through a central passage 18 of the casing string 16 and upwards through an annulus 20 formed between an outer surface of casing string 16 and within an inner surface of wall 22 of the wellbore 12.

Casing string 16 is formed of a plurality of relatively strong and heavy pipe sections or casing joints (or simply tubulars) coupled end-to-end at the surface 5 forming a long string that joint-by-joint is run into the wellbore 12. In this embodiment, the connections formed between the casing joints of casing string 16 comprise so-called premium connections configured to form a metal-to-metal seal to restrict the communication of fluids (including at least some gasses, such as air) between the central passage 18 of the casing string 16 and the annulus 20 as will be discussed in more detail below.

As the casing string 16 is assembled joint-by-joint at the surface 5 and run into the wellbore 12, a terminal end 26 of the string 16 first contacts part of the heel section 17 of the wellbore 12 and begins to experience frictional drag or resistance to moving further downhole deeper into the wellbore 12. Eventually, a bottom of an outer surface 28 of the heavy casing string 16 lays against a corresponding bottom 30 of the wellbore 12 mostly along the generally horizontal section 15. Movement along the bottom 30 may be described as frictional resistance or drag that increases in magnitude as the length of the horizontal section 15 of the casing string 16 increases. Considering that, in at least some applications, a desired or ideal run of horizontal section 15 of the wellbore 12 may extend for several miles, the frictional resistance to horizontal movement of the casing 16 begins to impose buckling forces on the casing string 16 mostly seen near the heel 17 of wellbore 12. Thus, the length of casing 16 in the horizontal section 15 of wellbore 12 may be effectively limited by the frictional resistance or drag imposed on the casing string 16 moving along the bottom of the wellbore 12. Noting that the frictional drag applied to casing string 16 varies depending on the effective weight of casing string 16, the total length of the horizontal section 15 of wellbore 12 may be increased or maximized by reducing the effective weight of casing string 16.

Recognizing that the wellbore is essentially fluid full with wellbore fluids, the effective weight of the casing string 16 may be effectively reduced by buoyant forces created by supplying air or other low-density fluids into the central passage 18 of casing string 16 having a density less (or preferably much less) than the density of the wellbore fluids present in the surrounding annulus 20. In other words, filling at least a portion of the central passage 18 of casing string 16 with a low-density fluid having a density less than the density of the wellbore fluids present in annulus 20 results in the application of a buoyancy forces to casing string 16 serving to effectively decrease the downward forces of the casing string 16 against the bottom 30 of wellbore 12. The low-density fluid preferably comprises air or a mixture of air and other fluids. However, it may be understood that the low-density fluid may comprise fluids other than air.

A dissolvable barrier assembly 100 is positioned within the central passage 18 of casing string 16 and is generally configured to restrict or seal against the flow of fluids (preferably including some gasses, such as air) across the dissolvable barrier assembly 100 when assembly 100 is in a first or undissolved state. In other words, the dissolvable barrier assembly 100, when in the undissolved state, fluidically isolates an uphole section of the central passage 18 extending uphole from assembly 100 from a downhole section of central passage 18 extending downhole from assembly 100. As will be further described herein, the dissolvable barrier assembly 100 is configured to remain in the undissolved state while the casing string 16 is run into the wellbore 12 and is configured to only pass from the undissolved state to a second or dissolved state after the casing string 16 has been fully installed and cemented into position in the wellbore 12. In this exemplary embodiment, the dissolvable barrier assembly 100 may be positioned far from the terminal end 26 of casing string 16 such that assembly 100 is potentially located in the vertical section 13 of wellbore 12 even when the casing string 16 is disposed in a final position for cementing. In other embodiments, the dissolvable barrier assembly 100 is positioned nearer the terminal end 26 of casing string 16 such that assembly 100 is located in the horizontal section 15 of wellbore 12 as the casing string 16 moves into the final position for cementing.

Additionally, in the present disclosure, the casing string 16 includes a float assembly 24 positioned near the terminal end 26 of the casing string 16. The float assembly 24 includes, among other equipment, a check valve that prevents fluid within the wellbore 12 from flowing back into the central passage 18 of casing string 16 at the end 26. While in this embodiment casing string 16 includes float assembly 24, in other embodiments, the assembly 24 is optional allowing some wellbore fluid to flow into the central passage 18 of the casing string 16.

The dissolvable barrier assembly 100 described herein provides a method for creating buoyancy in the casing 16. Particularly, the method includes installing the float assembly 24 into the casing string 16 typically by installing a specialized joint with the float assembly 24 therein between some of the first or lowermost joints in the casing string 16. While the lowermost joint of the casing string is inserted into the wellbore 12, the wellbore fluids will simply float up along both the inside and the outside of the casing string 16. The float assembly 24 includes a check valve that allows fluid to flow downhole through and out of the terminal end 26 of the casing 16 string but prevents fluid flow back uphole into and through the casing string 16. So, once the float assembly 24 is installed into the casing string 16, wellbore fluids will be prevented from flowing uphole into the central passage 18 of the casing string 16 while continuing to float up around the outside of the casing string 16 and residing only in the annulus outside the casing string 16 and within the walls of the wellbore 12 (some wellbore fluids infiltrate the ground around the walls of the wellbore 12, but that is not relevant for the present disclosure).

The dissolvable barrier assembly 100, once installed into the assembling casing string, divides the central passage 18 of casing string 16 into a first or uphole chamber 21 extending from the surface 5 downhole through central passage 18 to dissolvable barrier assembly 100, and a second or downhole chamber 23 extending from assembly 100 downhole through central passage 18 to a float assembly 24 near the bottom of the casing string 16. As the casing string 16 is assembled and run into wellbore 12 towards a predefined final position within wellbore 12, downhole chamber 23 naturally has air inside. It may be filled with an alternative low-density fluid which is less dense than that of the existing wellbore fluid 32, while the uphole chamber 21 is filled with a fluid having a density similar to or greater than the density of wellbore fluid 32. In some embodiments, the downhole chamber 23 is filled with air at ambient pressure (e.g., a pressure of about 15 pounds per square inch (PSI)), thereby providing a significant buoyancy force for the casing string 16. In applications in which casing string 16 is run into a deviated wellbore, such as wellbore 12, the increase in buoyancy of the casing string 16 translates into a reduction in the amount of frictional drag applied to the casing string 16 as it is run deep into the deviated wellbore. As described above, in the undissolved state or prior to dissolving, dissolvable barrier assembly 100 prevents fluid within uphole chamber 21 from communicating or flowing into the downhole chamber 23 as the casing string 16 is run into the wellbore 12. Additionally, the check valve of float assembly 24 nearer to the bottom end of the casing string 16 prevents wellbore fluid 32 from flowing uphole into the downhole chamber 23.

Figure 2:
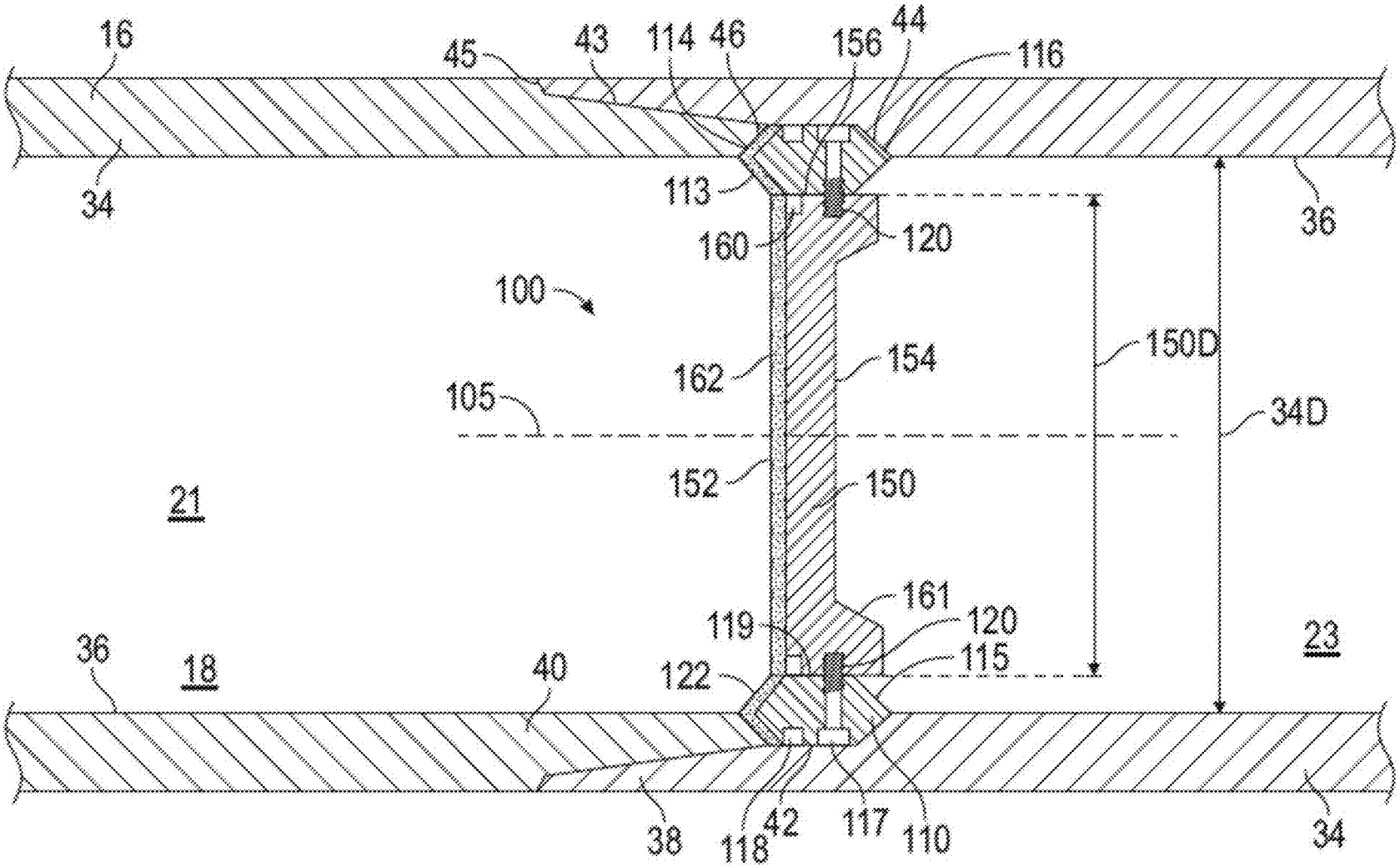
FIG. 2 is a schematic fragmentary cross-sectional view of the dissolvable barrier assembly of FIG. 1 in accordance with principles disclosed herein.

Referring to FIG. 2, an embodiment of the dissolvable barrier assembly 100 is shown. Particularly, FIG. 2 illustrates dissolvable barrier assembly 100 coupled between a pair of tubular or casing joints 34 of the casing string 16. Typically, a casing joint is a section of pipe that is about 40 feet long where the ends are modified to be connected end to end by screw threads. Each casing joint 34 comprises a cylindrical inner surface 36 defining an open central passage 18 extending the length of each casing joint 34. Additionally, in this exemplary embodiment, each casing joint 34 has a box end 38 with internal threads formed at an uphole end of the casing joint 34 and a pin end 40 with external threads formed at a downhole or opposite end of the casing joint 34.

As is conventional, a casing string 16 is assembled at the surface 5 by repeatedly adding joint after joint rotating the uphole joint and screwing it to the next joint down until many hundreds of feet of the casing joints are strung together as a string. As shown particularly in FIG. 3, the threaded connections 43 of casing joints 34 comprise rotary shouldered threaded connections (RSTCs) and in some embodiments, comprise premium connections configured to form a metal-to-metal seal 45 whereby fluids like air are substantially prevented from leaking through the threaded connection 43. However, it should be understood that embodiments disclosed herein may be practiced in other connection configurations. In this embodiment, the inner surface 36 of at least one casing joint 34 of casing string 16 includes an annular groove 42 extending into the wall thickness of the casing joint 34 and which is positioned adjacent to the box end 38 of the casing joint 34. Additionally, the annular groove 42 forms an annular first shoulder 44 on the inner surface 36 of the casing joint 34. Further, in this embodiment, the pin end 40 of at least one casing joint 34 of casing string 16 an annular second shoulder 46 opposite first shoulder 44.

In this embodiment, dissolvable barrier assembly 100 has a central or longitudinal axis 105 and generally includes an annular holder or mount 110 with a barrier 150 received within a central aperture of the holder 110. The holder 110 comprises an outer surface which includes a first or uphole surface 113 defining a first or uphole end of holder 110, a second or downhole surface 115 defining a second or downhole end of the holder 110 opposite the uphole end, a generally cylindrical circumferentially outer surface 117 extending between uphole and downhole surfaces 113 and 115 and defining a maximum outer diameter of holder 110, and a generally cylindrical radially inner surface 119 extending between uphole and downhole surfaces 113 and 115 and defining a minimum inner diameter of holder 110. In this embodiment, the uphole surface 113 comprises a pair of radially extending, first or uphole shoulders 114, and the downhole surface 115 comprises a pair of radially extending, second or downhole shoulders 116. During assembly of casing string 16, the dissolvable barrier assembly 100 may be positioned axially between the casing joints 34 as shown in FIG. 2. Once the dissolvable barrier assembly 100 is positioned between the casing joints 34, the threads of the box and pin ends 38 and 40, respectively, engage and twist together to form the threaded connection 43 shown in FIG. 2.

As the casing joints 34 shown in FIG. 2 are threaded together to form threaded connection 43, shoulders 114 and 116 of the casing joints 34 are clamped against holder 110 restricting relative movement between dissolvable barrier assembly 100 and the casing joints 34 along central axis 105. Particularly, first shoulder 44 of a downhole casing joint 34 of the pair of casing joints 34 shown in FIG. 2 contacts at least one of the downhole shoulders 116 of the holder 110 while the second shoulder 46 of the uphole casing joint 34 shown in FIG. 2 contacts at least one of the uphole shoulders 114 of the holder 110, thereby clamping the dissolvable barrier assembly 100 between the pair of casing joints 34. In this configuration, the dissolvable barrier assembly 100 may be run into wellbore 12 along with and as part of the casing string 16 where the assembly 100 serves to seal or isolate the uphole chamber 21 of casing string 16 from the downhole chamber 23 against the flow of any liquid or gaseous fluid. Although in this embodiment the dissolvable barrier assembly 100 is secured to the casing string 16 in the manner described above, in other embodiments, the assembly 100 may be secured to casing string 16 via a variety of mechanisms. For example, the holder 110 of the dissolvable barrier assembly 100 may be threadably coupled to the inner surface 36 of one of the casing joints 34 of casing string 16, or may be formed integrally or monolithically within one of the casing joints 34 of casing string 16, or may be carried by a specialized short joint for connecting with conventional casing joints.

In this embodiment, the circumferentially outer surface 117 of the holder 110 comprises an annular seal assembly 118 that sealingly engages the inner surface 36 of the groove 42 to seal the annular interface formed between the outer surface 112 of holder 110 and the inner surface 36 of the groove 42. In some embodiments, the seal assembly 118 comprises a D-ring seal; however, in other embodiments, seal assembly 118 may comprise any of various forms of seals, including T-seals. Additionally, the holder 110 includes one or more shear members or pins 120 which extend radially inwards towards central axis 105 of dissolvable barrier assembly 100. In this embodiment, holder 110 includes a plurality of circumferentially spaced shear pins 120; however, in other embodiments, the holder 110 may include only a single shear pin 120.

In this embodiment, the barrier 150 of the dissolvable barrier assembly 100 is generally disk-shaped and comprises an outer surface which includes first or uphole surface 152 defining a first or uphole end of the barrier 150, a second or downhole surface 154 defining a second or downhole end of the barrier 150 opposite the uphole end, and a generally cylindrical circumferentially outer surface 156 extending between the uphole and downhole surfaces 152 and 154 and defining a maximum outer diameter 150D of the barrier 150. While this embodiment includes a barrier 150 that is disk-shaped having a generally cylindrical circumferentially outer surface 152, in other embodiments, the barrier 150 may comprise various other shapes and configurations. In some embodiments, the maximum outer diameter 150D of barrier 150 may be less than a maximum inner diameter 34D of each casing joint 34 of the casing string 16 to prevent the barrier 150 from becoming wedged or otherwise stuck within a casing joint 34 once the barrier 150 is released from the holder 110.

In this embodiment, the circumferentially outer surface 156 of the barrier 150 comprises an annular seal assembly 160 that sealingly engages the radially inner surface 119 of the holder 110 to seal the annular interface formed between the circumferentially outer surface 156 of the barrier 150 and the radially inner surface 119 of the holder 110. In some embodiments, the seal assembly 160 may comprise a D-ring seal; however, in other embodiments, the seal assembly 160 may comprise various other forms of seals, including T-seals. Additionally, the circumferentially outer surface 156 of the barrier 150 comprises one or more apertures for receiving the one or more shear pins 120 extending radially inwards from the holder 110. The shear pins 120 are designed to yield at a pre-determined range of shear force applied to the shear pins 120, and connect the holder 110 with the barrier 150 to restrict relative movement along central axis 105 between the holder 110 and the barrier 150 until the shear force imposed on the shear pins 120 exceeds at least the low end of the predefine range at which point the barrier 150 disconnects from the holder 110. In this way, the shear pins 120 may be described as frangibly coupling the holder 110 to the barrier, but shear pins 120 are not inherently weak or fragile. When the shear pins 120 yield or sever as a result of a predetermined differential pressure across dissolvable barrier assembly 100 (e.g., across chambers 21 and 23 of casing string 16), the barrier 150 is released and permitted to move or travel axially relative to holder 110 and the casing string 16, as will be described further herein.

The downhole surface 154 of the barrier 150 may comprise one or more features configured to increase the surface area (at a given maximum outer diameter of barrier 150) of the downhole surface 154 exposed to the downhole chamber 23 of the casing string 16. Particularly, in this embodiment, the downhole surface 154 comprises an annular shoulder 161 formed thereon to increase the surface area of the downhole surface 154. In other embodiments, the downhole surface 154 of barrier 150 may comprise various other surface features intended to increase the surface area of downhole surface 154. For example, the downhole surface 154 may comprise a plurality of apertures or grooves formed therein, and/or a plurality of fins or other protrusions formed on the downhole surface 154.

Both the holder 110 and the barrier 150 of the dissolvable barrier assembly 100 comprise a material configured to chemically dissolve when exposed to fluids at wellbore conditions at a rate that is faster than materials configured to withstand wellbore conditions, such as at the rate which alloy steels and the like would be expected to dissolve or corrode. Such fluids may, in some applications, comprise corrosive fluids where the term "corrosive fluid" may include acidic fluids having a pH of less than seven. Exemplary corrosive fluids include wellbore fluids (wellbore fluid 32, for example), drilling fluids or muds, and other fluids having a high chlorine content. Corrosive fluids may include elevated levels of chlorine compounds such as Sodium Chloride (NaCL) and Potassium Chloride (KCL). Alternatively, the fluid may comprise fluids having a pH of seven or greater such as freshwater. In this embodiment, the holder 110 and the barrier 150 each comprise a magnesium-based alloy; however, in other embodiments, the holder 110 and the barrier 150 may comprise various types of corrodible or dissolvable materials, such as aluminum-based alloys, polymers, composites, etc. In other embodiments, the shear pins 120 may comprise a dissolvable material similar in configuration as the dissolvable materials comprising the holder 110 and the barrier 150.

At least a portion of the outer surfaces of the holder 110 and the barrier 150 are covered with a protective coating configured to prevent or at least inhibit the corrosion and/or dissolution of the portion of the outer surfaces of the holder 110 and the barrier 150 covered by the protective coating. Particularly, the portions of the outer surfaces of the holder 110 and the barrier 150 that are exposed to or otherwise susceptible to contact with fluid disposed within uphole chamber 21 of casing string 16 are covered by the protective coating. Conversely, the portions of the outer surfaces of the holder 110 and the barrier 150 that are exposed to or otherwise susceptible to contact with fluid disposed in downhole chamber 23 of casing string 16 do not need to be covered by the protective coating. The protective coating may be formulated to dissolve at a slower rate when exposed to corrosive fluids (e.g., wellbore fluid 32, drilling fluids or muds, and other acidic liquids which may have a high chlorine content) at wellbore conditions than the materials comprising the holder 110 and the barrier 150 described above.

In this embodiment, at least a portion of the uphole surface 113 of the holder 110 is covered by a protective coating 122 (shown schematically in FIG. 2) and at least a portion of the uphole surface 152 of the barrier 150 is covered by a protective coating 162 (shown schematically in FIG. 2) which may comprise the same coating material as the protective coating 122. Additionally, the portions of the circumferentially outer surface 117 and radially inner surface 119 of the holder 110 extending from uphole surface 113 to the seal assemblies 118 and 160, respectively, are also covered by the protective coating 122 given that these portions of surfaces 117 and 119 are exposed to the uphole chamber 21 of the casing string 16. Similarly, the portion of the circumferentially outer surface 156 of the barrier 150 extending from the uphole surface 152 to the seal assembly 160 is covered by the protective coating 162 given that this portion of the circumferentially outer surface 156 is also exposed to the uphole chamber 21 of the casing string 16. In this arrangement, the holder 110 is covered by the protective coating 122, while other embodiments may not have the holder 110 covered by a protective coating such as the protective coating 122 shown in FIG. 2.

The portion of the uphole surface 152 of barrier 150 defined by the protective coating 162 may corrode at slower rate when exposed to a fluid, such as a corrosive fluid, wellbore fluid at wellbore conditions (e.g., at elevated pressures and temperatures), etc., than the downhole surface 154 of barrier 150. For example, the portion of the uphole surface 152 defined by coating 162 may corrode when contacted by fluid within uphole chamber 21 at a first corrosion rate, while the downhole surface 154 of barrier 150 may corrode when contacted by fluid within uphole chamber 21 (e.g., following the severing of shear pins 120) at a second corrosion rate that is greater than the first corrosion rate.

Similarly, the portion of the uphole surface 113 of holder 110 defined by the protective coating 122 may corrode at slower rate when exposed to a fluid, such as a corrosive fluid, wellbore fluid at wellbore conditions (e.g., at elevated pressures and temperatures), etc., than the downhole surface 115 of holder 110. For example, the portion of the uphole surface 113 defined by coating 122 may corrode when contacted by fluid within uphole chamber 21 at a third corrosion rate, while the downhole surface 115 of holder 110 may corrode when contacted by fluid within uphole chamber 21 (e.g., following the severing of shear pins 120) at a fourth corrosion rate that is greater than the third corrosion rate. The third corrosion rate may be comparable to the first corrosion rate while the fourth corrosion rate may be comparable to the second corrosion rate described above.

Protective coatings 122 and 162 may comprise a powder coating, a ceramic coating, paint, a diffusion coating, a nickel coating, a conversion coating, a silicone coating, and/or any other protective coating generally configured to delay or prevent the dissolution of the surfaces of the holder 110 and the barrier 150 which are covered by the protective coatings 122 and 162, respectively. For example, in an alternative embodiment, the protective coatings 122 and 162 may dissolve after about six to ten continuous hours of exposure to the fluid disposed within the uphole chamber 21 of the casing string 16. Thus, the protective coatings 122 and 162 are preferably designed to delay the dissolution of the holder 110 and the barrier 150 by between about six and ten hours when continuously exposed to wellbore conditions. In other words, the protective coatings 122 and 162 retard the corrosion rate of the holder 110 and barrier 150 when exposed to a fluid such as a corrosive fluid. However, it should be understood that the designed delay in the dissolution of the holder 110 and the barrier 150 as provided by the protective coatings 122 and 162 may vary substantially depending on, for example, the conditions in the wellbore to which the protective coatings 122 and 162 are exposed. In some embodiments, the surfaces of holder 110 and barrier 150 are prepared via blasting, etc., prior to applying the coatings 122, and 162 to the outer surfaces of holder 110 and barrier 150, to ensure that the coatings 122 and 162 function fully as intended and are properly adhered to the surfaces of the holder 110 and the barrier 150.

Figure 3:
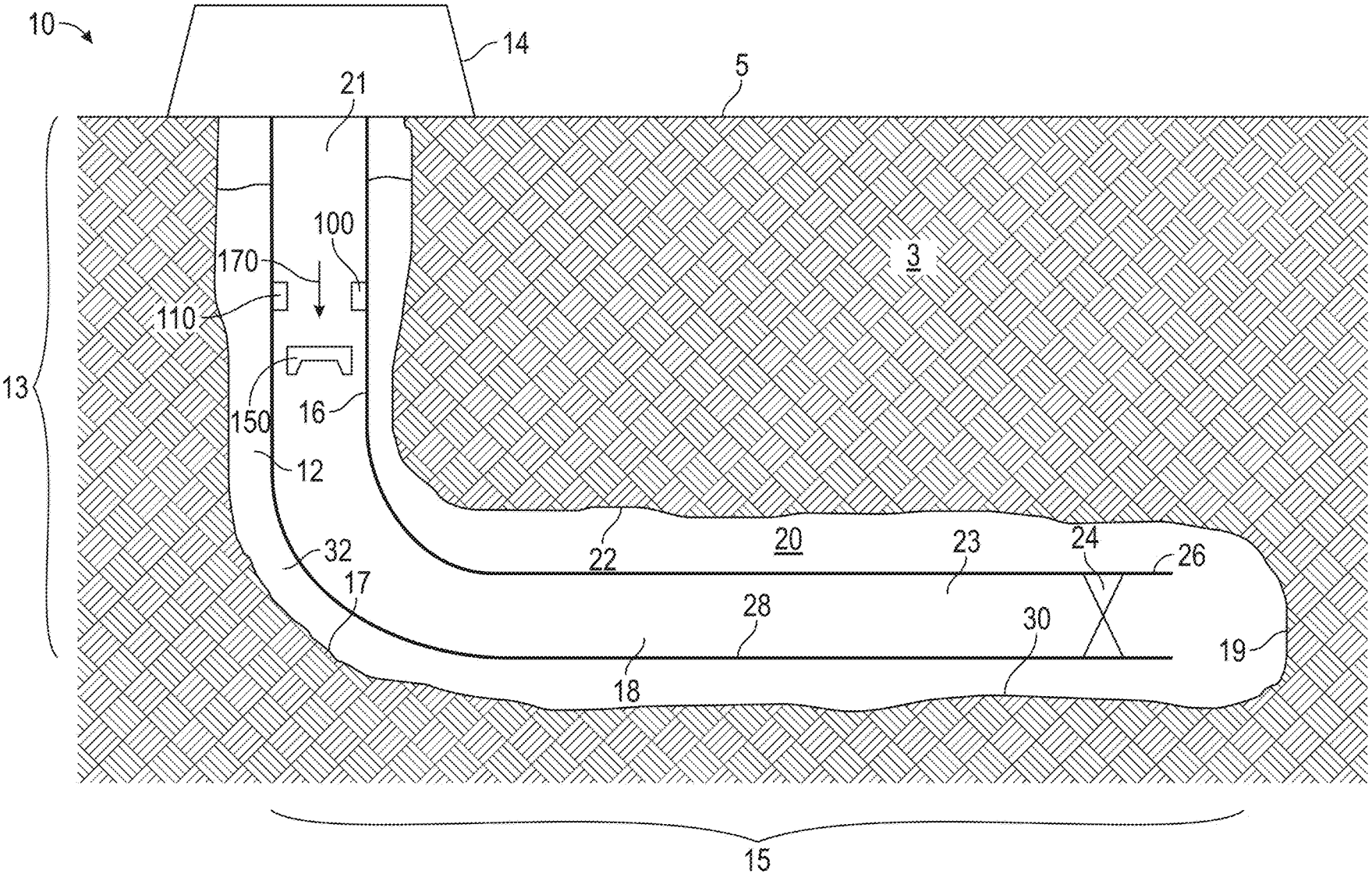
FIG. 3 is a schematic elevation view of the well system of FIG. 1 showing the process of installing casing to the toe of the wellbore.
Figure 4:
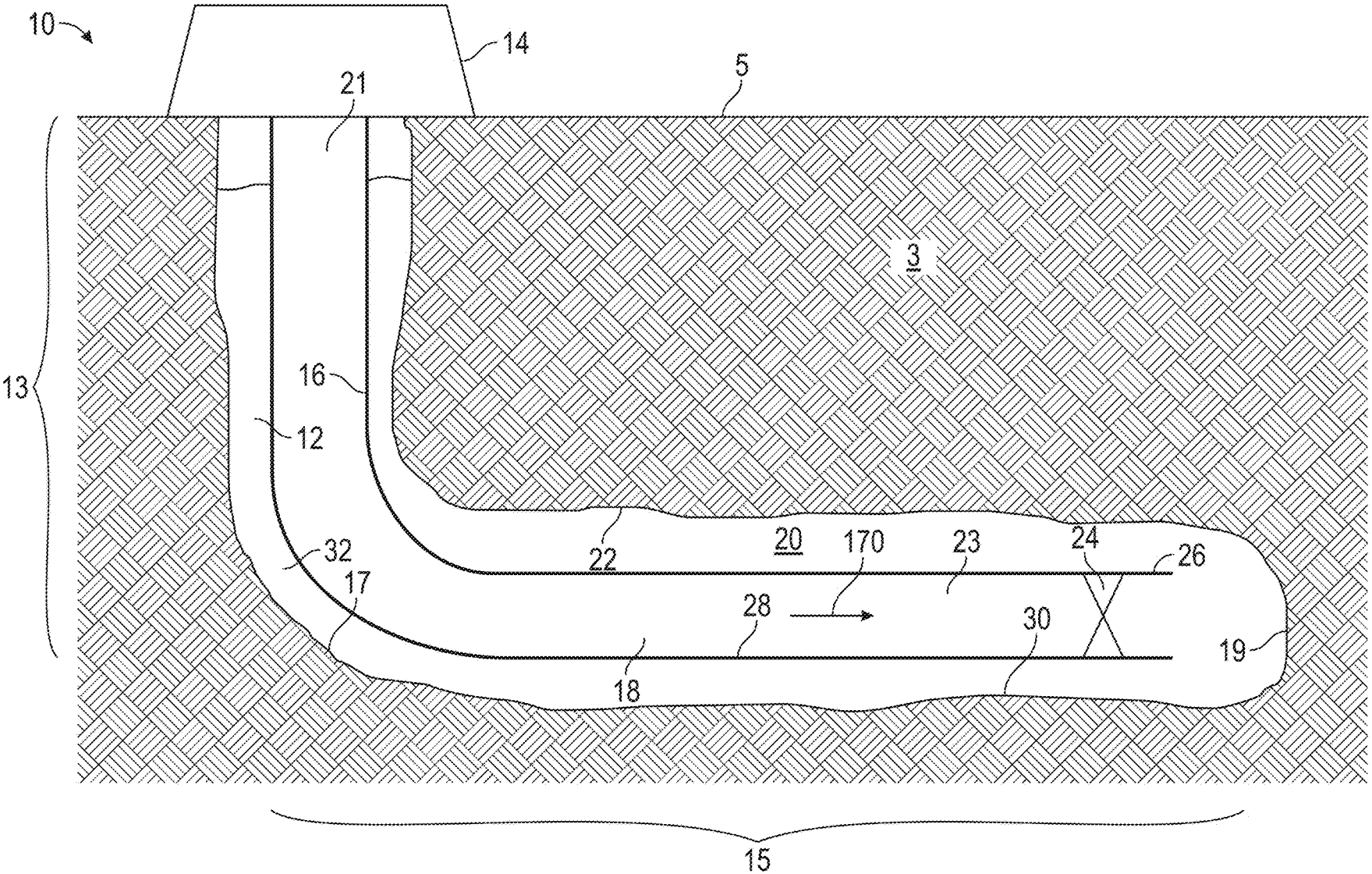
FIG. 4 is a second schematic elevation view of the well system of FIG. 1 showing the process of installing casing to the toe of the wellbore.

Turning now to FIGS. 3 and 4 the barrier 150 is configured to separate from the holder 110 in response to the application of a sufficient pressure on the dissolvable barrier assembly 100 over and above the pressure existing in the downhole chamber 23 by a predefined design threshold. As the casing string 16 is assembled and progressively run into the wellbore 12, the float assembly 24 is assembled with casing string 16 to prevent air at the surface from being displaced by wellbore fluid until dissolvable barrier assembly 100 is installed into the casing string 16 whereupon the uphole chamber 21 is filled with liquid (e.g., a drilling or completion fluid, etc.). Once casing string 16 has been fully assembled and run into the wellbore 12 to its full intended depth such that the string 16 occupies a final or cementing position, one or more pumps of the surface system 14 may be operated to increase fluid pressure within uphole chamber 21 until a pressure differential between the respective uphole and downhole chambers 21 and 23, respectively, and especially across dissolvable barrier assembly 100 reaches the threshold pressure differential.

At about the threshold pressure differential, each shear pin 126 breaks or severs releasing the barrier 150 from the holder 110 allowing fluid from uphole chamber 21 to flow into downhole chamber 23 (indicated by arrow 170 in FIG. 3) as particularly shown in FIG. 3. Additionally, following the release of the barrier 150 from the holder 110, the portions of the outer surfaces of the holder 110 and the barrier 150 that are not covered by protective coatings 122 and 162 become contacted by the fluid flowing into the downhole chamber 23 from the uphole chamber 21 and thus begin to dissolve or corrode. For example, the downhole surfaces 116 and 154 of the holder 110 and the barrier 150 are contacted by fluid from the uphole chamber 21 following the shearing of the shear pins 120. As the holder 110 and the barrier 150 each dissolve or pass into the dissolved state after the shearing of shear pins 120, the holder 110 and barrier 150 preferably dissolve entirely away although being reduced to small residual debris elements is within the scope of the disclosure. Preferably, whatever residual debris that remains settles out of the way at the bottom of the wellbore 12, or may be flushed with other materials with fluids pumped into or recirculated in the wellbore 12.

In embodiments where the holder 110 and the barrier 150 entirely dissolve by chemical action, full-bore access is provided to the central passage 18 of the casing string 16 for the pumping of fluids therethrough. In other words, following the dissolution of the holder 110 and the barrier 150, neither impedes fluid flow through the central passage 18 of the casing string 16 and the full dimension of the minimum inner diameter 34D of each casing joint 34 fully serves as the minimum diameter of that portion of the central passage 18 extending from the surface 5 to the float assembly 24. Additionally, given that the holder 110 and the barrier 150 chemically dissolve rather than mechanically break apart, once dissolved in response to chemical action with the corrosive fluids they preferably do not leave behind any fragments or other debris of sufficient size to impede the operation of other equipment coupled to casing string 16, such as float assembly 24.

In some embodiments, after the barrier assembly 100 has dissolved, completion fluids may be circulated downwards through the central passage 18, exiting the terminal end 26 of the casing string 16, and then flow upwards through the annulus 20 of the wellbore 12 to the surface 5. Any debris from the dissolved barrier assembly 100 may be conveniently flushed from wellbore 12 in this process. Similarly, cement is typically pumped downhole though the central passage 18 of the casing string 16 to turn and flow uphole through the annulus 20 to secure and seal the casing string 16 within and to the wellbore 12 in the final position therein.

Figure 5:
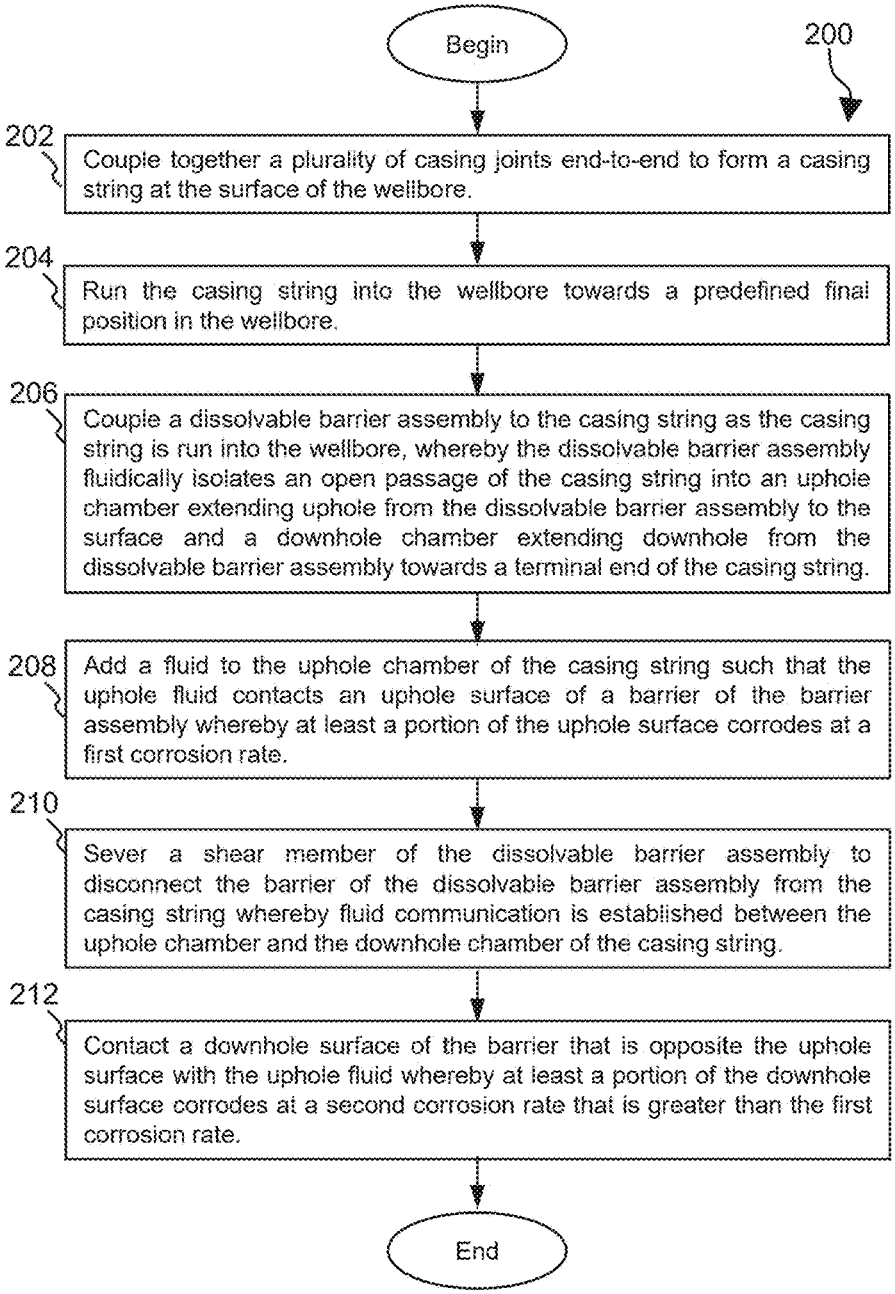
FIG. 5 is a flowchart of an embodiment of a method for installing a casing string in a wellbore.

Referring to FIG. 5, an embodiment of a method 200 for installing a casing string in a wellbore is shown. Initially, at block 202 method 200 includes coupling together a plurality of casing joints end-to-end to form a casing string at the surface of the wellbore. In some embodiments, block 202 includes coupling together a plurality of casing joints end-to-end to form the casing string 16 described above at the surface 5 of the wellbore 12. At block 204, method 200 includes running the casing string into the wellbore towards a predefined final position in the wellbore. In some embodiments, block 204 includes running the casing string 16 into the wellbore 12 towards a predefined final position in the wellbore 12.

At block 206, method 200 includes coupling a dissolvable barrier assembly to the casing string as the casing string is run into the wellbore, whereby the dissolvable barrier assembly fluidically isolates an open passage of the casing string into an uphole chamber extending uphole from the dissolvable barrier assembly to the surface and a downhole chamber extending downhole from the dissolvable barrier assembly towards (but not necessarily to) a terminal end of the casing string. In some embodiments, block 206 includes coupling the dissolvable barrier assembly 100 described previously to the casing string 16 as the casing string 16 is run into the wellbore 12. At block 208, method 200 includes adding a fluid to the uphole chamber of the casing string such that the uphole fluid contacts an uphole surface of a barrier of the barrier assembly whereby at least a portion of the uphole surface corrodes at a first corrosion rate. In some embodiments, block 208 includes adding fluid, such as an acidic fluid, to the uphole chamber 21 described above and contacting the uphole surface 152 of the barrier 150 with the uphole fluid whereby at least a portion of the uphole surface 152 corrodes at a first corrosion rate. The portion of the uphole surface 152 of barrier 150 which corrodes at the first corrosion rate may be defined by the protective coating 162.

At block 210, method 200 includes severing a shear member of the dissolvable barrier assembly to disconnect the barrier of the dissolvable barrier assembly from the casing string whereby fluid communication is established between the uphole chamber and the downhole chamber of the casing string. In some embodiments, block 210 includes severing the shear pins 120 of the dissolvable barrier assembly 100 described previously to disconnect the barrier 150 of the assembly 100 from the holder 110 of the assembly 100. At block 212, method 200 includes contacting a downhole surface of the barrier that is opposite the uphole surface with the uphole fluid whereby at least a portion of the downhole surface corrodes at a second corrosion rate that is greater than the first corrosion rate. In some embodiments, block 212 includes contacting the downhole surface 154 of the barrier (opposite uphole surface 152) with uphole fluid from uphole chamber 21 whereby at least a portion of the downhole surface 154 corrodes at a second corrosion rate that is greater than the first corrosion rate. The portion of the downhole surface 154 of barrier 150 which corrodes at the second corrosion rate may not be defined (i.e., not covered) by the protective coating 162.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A dissolvable barrier assembly deployable with a casing string in a wellbore, the dissolvable barrier comprising:

a holder configured to couple to the casing string in a generally transverse orientation and defining a central aperture;

a barrier positioned in the central aperture of the holder and configured to prevent the communication of fluid across the barrier whereby an uphole chamber within the casing string extending uphole from the barrier and containing an uphole fluid is hydraulically isolated from a downhole chamber within the casing string extending downhole from the barrier;

wherein the barrier comprises an outer surface including an uphole surface defining an uphole end and a downhole surface defining a downhole end opposite the uphole end, wherein the downhole surface of the barrier has a greater surface area than the uphole surface of the barrier, at least a portion of the uphole surface is configured to corrode when in contact with the uphole fluid at a first corrosion rate, and least a portion of the downhole surface is configured to corrode when in contact with the uphole fluid at a second corrosion rate that is greater than the first corrosion rate;

a first seal assembly positioned on a circumferentially outer surface of the holder and configured to seal an interface between the circumferentially outer surface and an inner surface of the casing string when the dissolvable barrier assembly is positioned in the casing string; and a second seal assembly positioned circumferentially between an inner surface of the holder and an outer surface of the barrier, wherein the second seal assembly is configured to seal the interface between the inner surface of the holder and the outer surface of the barrier.

2. The barrier assembly of claim 1, wherein at least one of the first seal assembly and the second seal assembly comprises an annular D-ring seal.

3. The barrier assembly of claim 1, wherein at least one of the first seal assembly and the second seal assembly comprises an annular T-ring seal.

4. The barrier assembly of claim 1, wherein both the first seal assembly and the second seal assembly comprises an annular T-ring seal.

5. The barrier assembly of claim 1, wherein both the first seal assembly and the second seal assembly include a D-ring seal.

6. The barrier assembly of claim 1, wherein one of the first seal assembly and the second seal assembly comprises an annular D-ring seal and the other of the first seal assembly and the second seal assembly comprises an annular T-seal.

7. The dissolvable barrier assembly of claim 1, wherein an annular shoulder is formed on the downhole surface of the barrier.

8. The dissolvable barrier assembly of claim 1, wherein both the first seal assembly and the second seal assembly are each located axially between the uphole end and the downhole end of the barrier.

9. The dissolvable barrier assembly of claim 1, wherein the portion of the uphole surface of the barrier configured to corrode at the first corrosion rate when in contact with the uphole fluid is defined by an uphole protective coating formed on the barrier.

10. A well system, comprising:

a casing string positioned in a wellbore extending through a subterranean, earthen formation; and the dissolvable barrier assembly of claim 1 positioned in a central passage of the casing string.

11. The barrier of claim 1, wherein the uphole surface has an outer diameter that is equal to an outer diameter of the downhole surface.

12. The barrier of claim 11, wherein the downhole surface comprises an annular shoulder that is spaced radially inwards from the outer diameter of the downhole surface.

13. A dissolvable barrier assembly deployable with a casing string in a wellbore, the dissolvable barrier comprising:

a holder configured to couple to the casing string in a generally transverse orientation and defining a central aperture; and a barrier positioned in the central aperture of the holder and configured to prevent the communication of fluid across the barrier whereby an uphole chamber within the casing string extending uphole from the barrier and containing an uphole fluid is hydraulically isolated from a downhole chamber within the casing string extending downhole from the barrier;

wherein the barrier comprises an outer surface including an uphole surface defining an uphole end and a downhole surface defining a downhole end opposite the uphole end and having a greater surface area than the uphole surface, wherein the uphole surface has an outer diameter equal to an outer diameter of the downhole surface, wherein at least a portion of the uphole surface is configured to corrode when in contact with the uphole fluid at a first corrosion rate and also wherein at least a portion of the downhole surface is configured to corrode when in contact with the uphole fluid at a second corrosion rate that is greater than the first corrosion rate.

14. The dissolvable barrier assembly of claim 13, wherein an annular shoulder is formed on the downhole surface of the barrier.

15. The dissolvable barrier assembly of claim 13, wherein the barrier comprises at least one of a magnesium-based alloy and an aluminum-based alloy.

16. The dissolvable barrier assembly of claim 13, wherein the portion of the uphole surface of the barrier configured to corrode at the first corrosion rate when in contact with the uphole fluid is defined by an uphole protective coating formed on the barrier.

17. The dissolvable barrier assembly of claim 16, wherein the uphole protective coating comprises at least one of a powder coating, a ceramic coating, and paint.

18. The dissolvable barrier assembly of claim 13, further comprising:

a first seal assembly positioned on a circumferentially outer surface of the holder and configured to seal an interface between the circumferentially outer surface and an inner surface of the casing string when the dissolvable barrier assembly is positioned in the casing string; and a second seal assembly positioned circumferentially between an inner surface of the holder and an outer surface of the barrier, wherein the second seal assembly is configured to seal the interface between the inner surface of the holder and the outer surface of the barrier.

19. The barrier assembly of claim 18, wherein at least one of the first seal assembly and the second seal assembly comprises an annular D-ring seal.

20. The barrier assembly of claim 18, wherein at least one of the first seal assembly and the second seal assembly comprises an annular T-ring seal.

21. A well system, comprising:

a casing string positioned in a wellbore extending through a subterranean, earthen formation; and the dissolvable barrier assembly of claim 13 positioned in a central passage of the casing string.

* * * * *